US010326191B2

(12) United States Patent
Theveneau et al.

(10) Patent No.: US 10,326,191 B2
(45) Date of Patent: Jun. 18, 2019

(54) SPATIAL POWER COMBINER

(71) Applicants: Commissariat A L'Energie Atomique et Aux Energies Alternatives, Paris (FR); Microwave Characterization Center, Sainghin-en-Melantois (FR); Universite Sciences Technologies Lille, Villeneuve D'Ascq (FR)

(72) Inventors: Hadrien Theveneau, Lille (FR); Matthieu Werquin, Lesquin (FR); Christophe Gaquière, Villeneuve D'ascq (FR)

(73) Assignees: MICROWAVE CHARACTERIZATION CENTER, Sainghin-en-Melantois (FR); UNIVERSITE SCIENCES TECHNOLOGIES LILLE, Villeneuve D'Ascq (FR); COMMISSARIAT A L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 0 days.

(21) Appl. No.: 15/357,441

(22) Filed: Nov. 21, 2016

(65) Prior Publication Data

US 2017/0149113 A1 May 25, 2017

(30) Foreign Application Priority Data

Nov. 23, 2015 (FR) ..... 1561267

(51) Int. Cl.

| | |
|---|---|
| ***H01P 1/23*** | (2006.01) |
| ***H01P 1/30*** | (2006.01) |
| ***H01P 3/08*** | (2006.01) |
| ***H01P 5/02*** | (2006.01) |
| ***H01P 5/12*** | (2006.01) |
| ***H01P 5/16*** | (2006.01) |

(52) U.S. Cl.

CPC ..... *H01P 5/16* (2013.01); *H01P 1/30* (2013.01); *H01P 3/081* (2013.01); *H01P 5/028* (2013.01); *H01P 5/12* (2013.01); *H01P 1/23* (2013.01)

(58) Field of Classification Search

CPC ..... H01P 5/16; H01P 1/30; H01P 3/081

See application file for complete search history.

(56) References Cited

U.S. PATENT DOCUMENTS

| | | | |
|---|---|---|---|
| 4,129,839 | A | 12/1978 | Galani et al. |
| 4,371,845 | A | 2/1983 | Pitzalis, Jr. |
| 4,424,496 | A | 1/1984 | Nichols et al. |
| 5,142,253 | A | 8/1992 | Mallavarpu et al. |
| 5,262,739 | A | 11/1993 | Dalman |
| 7,215,220 | B1 | 5/2007 | Jia |

OTHER PUBLICATIONS

Search Report dated Sep. 8, 2016 in French patent application No. FR1561267, 2 pages.

*Primary Examiner* — Robert J Pascal
*Assistant Examiner* — Kimberly E Glenn
(74) *Attorney, Agent, or Firm* — Brinks Gilson & Lione

(57) ABSTRACT

A spatial power combiner includes several inputs to which are respectively linked a plurality of transmission lines, and an output. A body defines a cavity and the plurality of transmission lines pass longitudinally through the cavity and are disposed around an absorbent member also extending longitudinally in the cavity. A power amplification set includes the spatial power combiner and an amplification structure at the input of the spatial power combiner.

15 Claims, 5 Drawing Sheets

SPATIAL POWER COMBINER

RELATED APPLICATIONS

This application claims priority under 35 U.S.C. § 119 to French Patent Application No. 1561267, filed Nov. 23, 2015, the entire content of which is hereby incorporated by reference

TECHNICAL FIELD

The present invention concerns a spatial power combiner including several inputs and one output.

BACKGROUND

A power combiner is a device enabling the power from several inputs to be combined into a single output.

The generation of high power is necessary in certain applications, for example in radar systems in order to emit a high power signal or communication systems in order to deliver a high power signal to a communication channel.

As the level of power output of a single power amplifier is often insufficient, a power combiner is necessary to add or combine power outputs from several power amplifiers.

Thus, power combiners are often used with a set of power amplifiers, each power amplifier amplifying an input signal and supplying an output signal. The power combiner combines the power of the output signals from the power amplifiers and generates a total output power.

Numerous architectures for power combiners exist. A spatial power combiner is one type of power combiner constituted by a cavity supplied by signals coming respectively from a set of input transmission lines. The power coming from each line is combined and collected into a central output transmission line.

In the current spatial power combiners, the inputs of the power combiner are not isolated from each other. Thus, as each input of the combiner influences the other inputs, a failure at one input or at components linked to that input is able to be propagated to the other inputs.

Furthermore, a fault of a single power amplifier may lead to a large degradation in the performance of the power combiner, which may lead to a fault in the operation of the device in which the power combiner is used.

SUMMARY

An object of the present invention is to overcome at least one of the aforesaid drawbacks and to provide a spatial power combiner in which the reliability is improved.

To that end, according to a first aspect the present invention provides a spatial power combiner comprising several inputs to which are respectively linked a set of transmission lines, and an output.

The spatial power combiner further comprises a body forming a cavity, the set of transmission lines passing longitudinally through said cavity and being disposed around an absorbent member extending longitudinally in said cavity.

The absorbent member makes it possible to isolate the transmission lines from each other, the signals carried by the transmission lines thus not influencing each other.

Furthermore, in case of a fault in a transmission line, that transmission line has no effect on the other transmission lines of the set and the power combiner still delivers an adequate output signal, in the worst of cases it being possible that the power at the output is reduced.

In an embodiment, the length of the absorbent member is equal to the length of the transmission lines in the spatial power combiner.

Thus, the absorbent member extends longitudinally over the entirety of the length of the transmission lines, which improves the isolation between the inputs and may facilitate the assembly of the power combiner at the time of its manufacture.

In another embodiment, the length of the absorbent member is less than the length of the transmission lines in the spatial power combiner.

By virtue of the reduction in the length of the absorbent member relative to the length of the transmission lines, the magnetic and dielectric losses due to the absorbent are reduced.

In a particular case, the absorbent member extends starting from the input of said spatial power combiner.

By virtue of this provision of the absorbent member, the evacuation of the energy dissipated in the form of heat in the power combiner is improved due to the fact that the heat travels a shorter distance.

In another particular case, the absorbent member extends starting from the output of said spatial power combiner.

In an embodiment, the spatial power combiner further comprises heat dissipation means extending longitudinally in the cavity, the absorbent member surrounding the dissipation means.

According to a feature, the heat dissipation means comprise a metal rod.

In particular, in the case in which the absorbent member extends starting from the input and the absorbent member is shorter than the length of the transmission lines, the distance traveled by the heat along the metal rod is reduced.

According to a feature, the transmission lines are microstrip transmission lines.

Thus, the connection of the input transmission lines to electronic circuits is facilitated.

Furthermore, no transition to another type of transmission line is necessary, avoiding losses linked to the transitions between different types of transmission lines.

According to another feature, the inputs of the spatial power combiner have a low impedance.

The connection of the inputs of the combiner to electronic circuits or components having low impedance outputs is thus facilitated. As a matter of fact, when the impedance values are close, implementing the adaptation of impedances is simplified.

According to another feature, the spatial power combiner comprises a heat evacuation module.

This heat evacuation module assists in the heat dissipation of the spatial power combiner.

According to an embodiment, the spatial power combiner comprises an impedance preadaptation module disposed at the input of the spatial power combiner, the impedance preadaptation module comprising first parts of the transmission lines of the set of transmission lines.

In an embodiment, each first part of the transmission lines comprises a set of layers, the set of layers comprising:

1) at least one first conductive layer transporting a signal and having a width reducing along that first part of the transmission line, and
2) at least one second conductive layer serving as a reference for potential and comprising an opening having a width increasing along the first part of said transmission line.

Thus, on account of the variations in the width of the first conductive layer and of the opening of the second conductive layer, the impedance value of the transmission line varies along the transmission line.

In particular, the impedance increases along the transmission line.

Therefore, the impedance value of a transmission line at the input of the spatial power combiner is less than the impedance value of the transmission line at the output of the combiner.

In a variant of this embodiment, the set of layers comprises a third conductive layer serving as a reference for potential.

In another variant of this embodiment, the impedance preadaptation module comprises a support on which are disposed the first parts of the transmission lines, the support comprising a set of hollows, each first part of the transmission lines of the set of transmission lines being respectively disposed on a hollow of the set of hollows.

Thus, the second conductive layer of each set of layers of each transmission line is in contact with each hollow of the support.

According to a second aspect, the present invention concerns a power amplification set formed by a spatial power combiner in accordance with the invention and an amplification structure disposed at the input of said spatial power combiner, the amplification structure comprising a set of inputs and a set of outputs, the outputs being respectively linked to the inputs of the spatial power combiner.

Therefore, the transmission lines of the spatial power combiner are connected to the outputs of the amplification structure.

Thus, the spatial power combiner combines the powers respectively present at the outputs of the amplification structure.

Furthermore, the transmission lines at the input of the spatial power combiner respectively correspond to the transmission lines at the output of the amplification structure.

According to a feature, the amplification structure comprises a set of power amplifiers, each power amplifier being linked to each output of the amplification structure.

Thus, the signals at the input of the power combination set are first amplified and then their power is combined, by the spatial power combiner, as a single output.

According to a feature, the outputs from the power amplifiers have a low impedance.

Thus, the impedance adaptation between the amplification structure and the power combiner is easily carried out.

The power amplification set has features and advantages that are similar to those described above in relation to the spatial power combiner.

Still other particularities and advantages of the invention will appear in the following description.

BRIEF DESCRIPTION OF THE DRAWING

In the accompanying drawings, given by way of non-limiting example.

DETAILED DESCRIPTION

A power amplification set in accordance with the invention will be described with reference to FIGS. 1*a* and 1*b*.

Figure 1A:
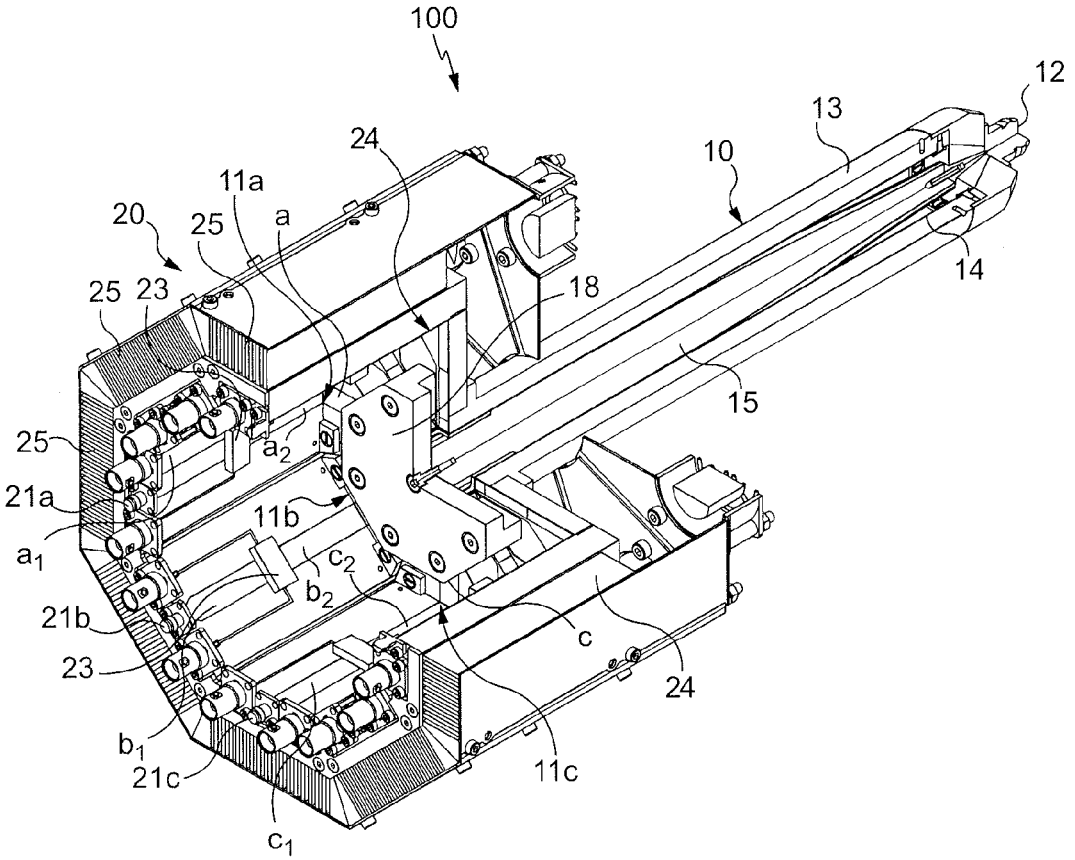
FIG. 1*a* represents a perspective view with partial cutting away of a power amplification set according to an embodiment of the invention comprising a spatial power combiner according to a first embodiment of the invention.

FIG. 1*a* represents a power amplification set 100 comprising a spatial power combiner 10 and an amplification structure 20.

Figure 1B:
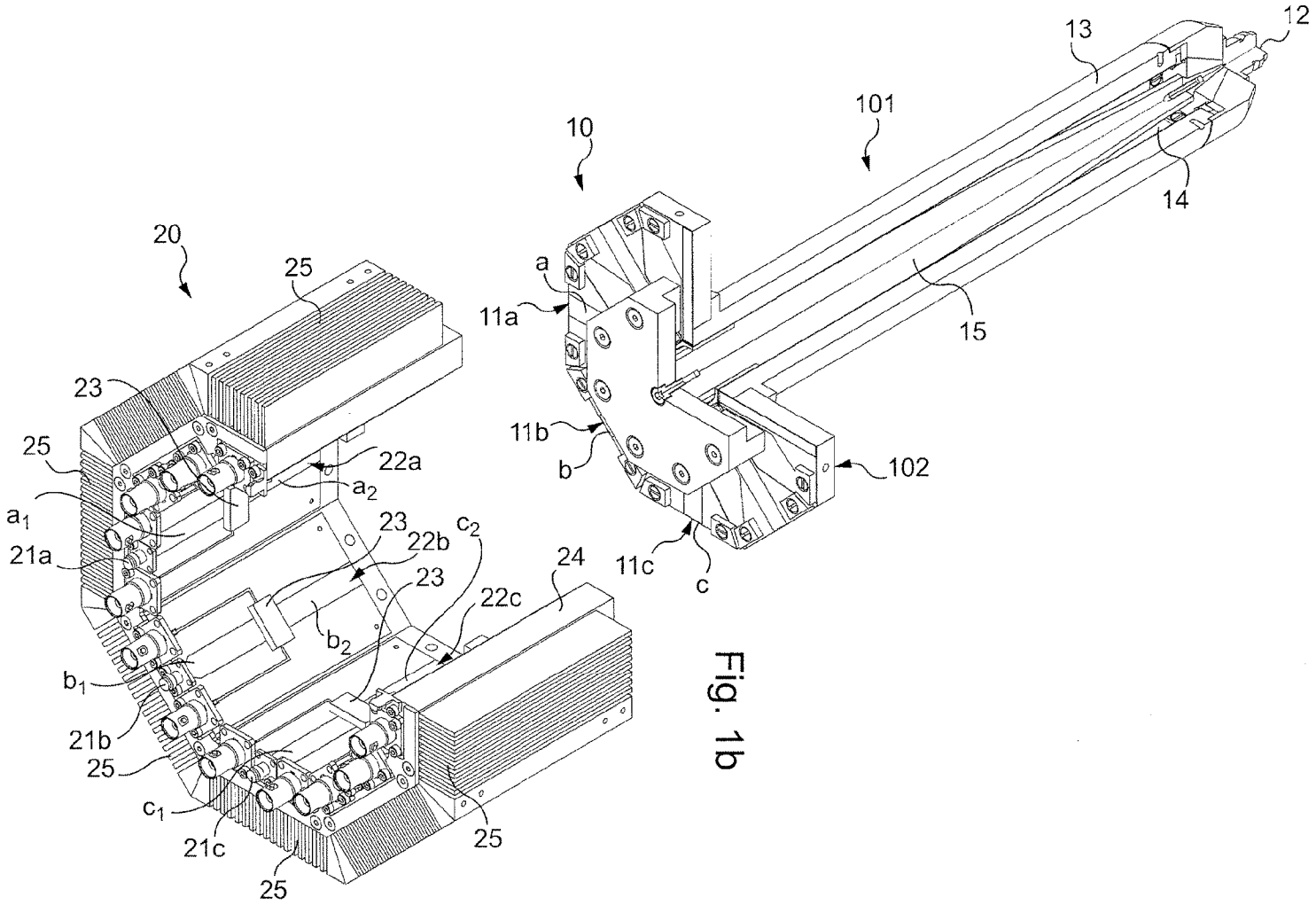
FIG. 1*b* represents an exploded perspective view of the power amplification set of FIG. 1*a*.

An exploded view of the power amplification set is represented in FIG. 1*b*.

The spatial power combiner 10 is disposed at the output of the amplification structure 20.

The amplification structure 20 comprises a set of inputs 21*a*, 21*b*, 21*c*, . . . and a set of outputs 22*a*, 22*b*, 22*c*, . . . , the number of inputs and outputs of the sets being identical.

It will be noted that below in this document, the inputs of the amplification structure 20 are referenced 21 and the outputs 22.

The amplification structure 20 further comprises a set of power amplifiers 23, each power amplifier 23 being linked to an input 21 of the amplification structure 20 and to an output 22 of the amplification structure 20.

Input transmission lines $a_1$, $b_1$, $c_1$ . . . respectively link the inputs 21 of the amplification structure 20 and the power amplifiers 23. Output transmission lines $a_2$, $b_2$, $c_2$ . . . respectively link the power amplifiers 23 and the outputs 22 of the amplification structure 20.

Thus, the power amplifiers 23 respectively amplify the signals at the inputs 21 of the amplification structure 20 and generate amplified signals at the outputs 22.

The amplification structure 20 comprises a body 24 enclosing the power amplifiers 23 and the input transmission lines $a_1$, $b_1$, $c_1$ . . . and output transmission lines $a_2$, $b_2$, $c_2$ . . . .

In the embodiment represented in FIGS. 1*a* and 1*b*, the body 24 is of octagonal shape, and the amplification structures comprise eight inputs 21, eight outputs 22, as well as eight power amplifiers 23. Each set formed by a power amplifier 23, an input transmission line $a_1$, $b_1$, $c_1$ . . . and an output transmission line $a_2$, $b_2$, $c_2$ . . . is disposed on a face of the body 24 of octagonal shape.

Of course, the body of the amplification structure may have different geometric shapes, and the number of inputs, power amplification outputs and transmission lines may be different.

It will be noted that in this partial view with partial cutting away represented in FIG. 1*a*, only three of the aforementioned sets are visible.

As the power amplifiers 23 are known to the person skilled in the art, they will not be described in more detail in this document.

In the represented embodiment, the amplification structure 20 comprises cooling means 25 disposed on the periphery of the body 24 in order to dissipate the heat produced by the power components, in particular by the power amplifiers 23.

The spatial power combiner 10 is disposed at the output of the amplification structure 20.

The outputs 22 of the amplification structure 20 are linked to inputs 11*a*, 11*b*, 11*c*, . . . (designated 11 below in this document) of the spatial power combiner 10. The powers of the signals at the output of the amplification structure 20 are thus combined by the spatial power combiner 10 into a single output power of the spatial power combiner 10.

Thus, the spatial power combiner 10 of the transmission lines a, b, c, . . . are respectively linked to the inputs 11*a*, 11*b*, 11*c*, . . . of the spatial power combiner 10.

It will be noted that the transmission lines a, b, c, . . . of the spatial power combiner 10 are a continuation of the output transmission lines $a_2$, $b_2$, $c_2$ . . . of the amplification structure 20.

The spatial power combiner 10 further comprises an output 12 on which a combined power is generated.

On this output 12, a combined output signal is thus generated, having a power corresponding to the combined powers of the input signals 11 of the spatial power combiner 10. Therefore, at the output 12, there is generated a combined output signal having a power corresponding to the combined powers of the output signals of the amplification structure 20.

Electronic equipment may be linked to the output 12 of the spatial power combiner 10 in order to use this combined power.

It will be noted that in the example embodiment described, the output 12 has high impedance, having, as an example that is in no way limiting, 50 Ohms.

The signal at the output 12 of the spatial power combiner 10 may thus be used, for example in an antenna or as input to a device serving as a transition for a wave guide to a coaxial line, without requirement for impedance transformation, or with an impedance transformation that is easy to carry out.

The spatial power combiner 10 comprises a cylindrical body 13 forming a cavity 14.

The transmission lines a, b, c, . . . comprise a first part corresponding to the portion of line between the input 11 and the cavity 14 of the spatial power combiner 10.

Below in this document, the part of the spatial power combiner at the location of the cavity 14 will be named core 101 of the combiner. The first part of a transmission line a, b, c, . . . is also named access line aa, ba, ca, . . . .

Each input line a, b, c, . . . further comprises a second part ab, bb, cb, corresponding to the portion of line between the access line aa, ba, ca . . . and the output 12 of the combiner. The second parts of the transmission lines ab, bb, cb, . . . pass longitudinally through the cavity 14 starting from the input 11 of the spatial power combiner 10 and extending to the output 12 of the spatial power combiner 10.

In the described embodiment, the input transmission lines a, b, c . . . are microstrip transmission lines.

Thus, provided that the power amplifiers 23 deliver output signals to microstrip lines, the connection between the amplification structure 20 and the spatial power combiner 10 may be made directly and without requiring conversions between different types of lines.

Losses due to the transformation of the signals between lines of different types are thus avoided.

The spatial power combiner 10 comprises an absorbent member 15 extending longitudinally in the cavity 14.

The absorbent member 15 is placed between the input transmission lines a, b, c, . . . in particular between the second parts of the transmission lines ab, bb, cb, . . . in the core 101 of the combiner.

More particularly, the second parts of input transmission lines ab, bb, cb, . . . are disposed around the absorbent member 15.

In the embodiment represented in FIG. 1, the absorbent member 15 extends over the whole length of the second parts of transmission lines ab, bb, cb, . . . that is to say that it extends over the entirety of the cavity 14 between the input 11 and the output 12 of the spatial power combiner 10, more particularly over the entirety of the core 101 of the spatial power combiner.

Therefore, in this embodiment, the length of the absorbent member 15 is equal to the length of the second parts of the transmission lines ab, bb, cb, . . . in the spatial power combiner 10.

Figure 2:
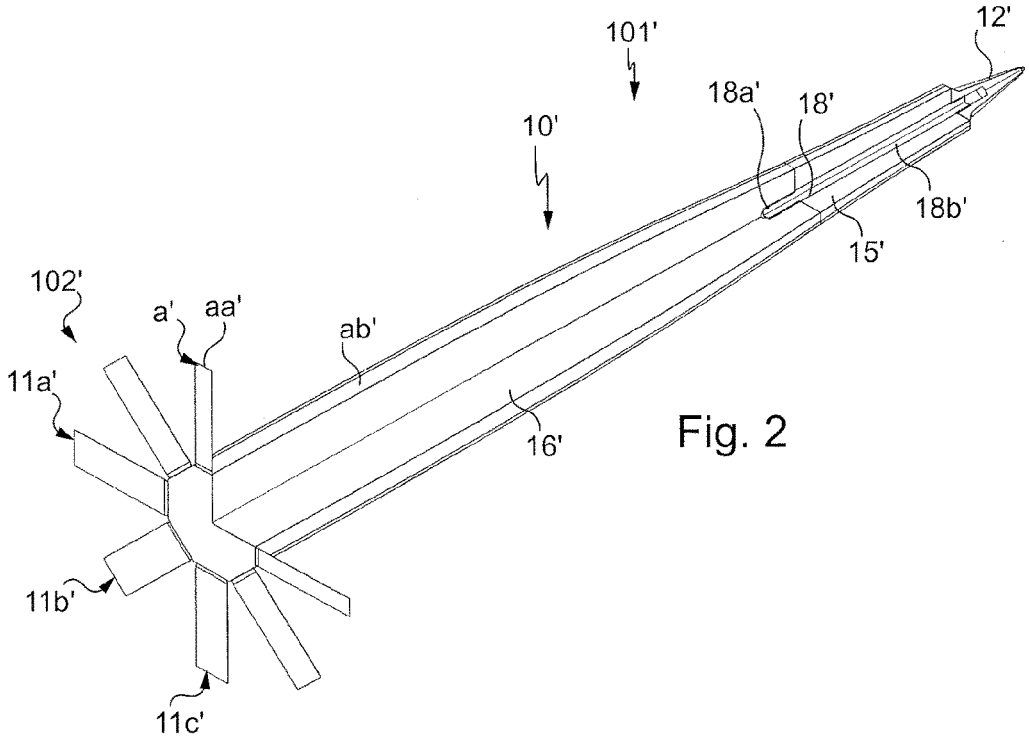
FIG. 2 represents a perspective view with partial cutting away of the power combiner according to a second embodiment of the invention.
Figure 3:
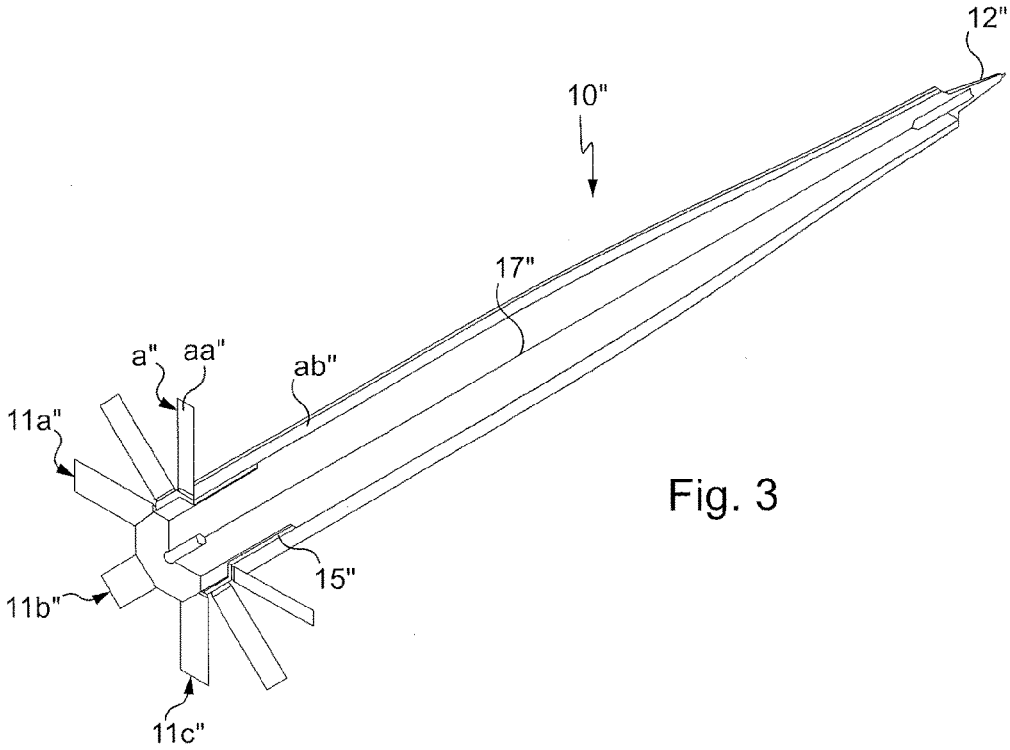
FIG. 3 represents a perspective view with partial cutting away of the power combiner according to a third embodiment of the invention.

In other embodiments, such as the embodiment represented in FIGS. 2 and 3, the length of the absorbent member 15 is less than the length of the second parts of the transmission lines ab, bb, cb, . . . in the spatial power combiner 10.

FIG. 2 represents a spatial power combiner 10' according to a second embodiment of the invention. It will be noted that the cavity is not represented in this FIG. 2.

In this embodiment, the transmission lines a', b', c', . . . and in particular the second parts of the transmission lines ab', bb', cb', . . . are disposed around the absorbent member 15', the absorbent member 15' extending longitudinally in a part of the cavity (not shown in the FIG. 2).

In this embodiment, the absorbent member 15' extends starting from the outlet 12' of the spatial power combiner 10' over a predetermined length.

By way of example that is in no way limiting, the predetermined length may be 50 mm.

Naturally, the value of this predetermined length may be different, this value varying for example according to the nature of the absorbent member 15' used.

In an embodiment, the absorbent member 15 comprises an absorbent material, such as an epoxy resin with a filler of particles of a magnetic absorbent material, for example ferrite particles.

In this embodiment, the spatial power combiner 10' further comprises a plastic member 16' extending longitudinally in the cavity, as an extension to the absorbent member 15'.

The plastic member 16' has a mechanical function, enabling the transmission lines a', b', c', . . . to be held in place.

In this embodiment, the absorbent member 15' and the plastic member 16' are fastened together by means of a threaded rod disposed in a recess 18' formed in the absorbent member 15' and the plastic member 16'.

Thus, the absorbent member 15' and the plastic member 16' are fastened together by screwing.

In particular, a first part of the recess 18*a*', corresponding to the recess formed in the plastic member 16', is a tapped longitudinal recess, the walls of the recess 18' thus forming a screw thread. A second part of recess 18*b*', corresponding to the recess formed in the absorbent member 15', is a recess of which the walls are smooth.

Of course, the fastening of the absorbent member 15' and of the plastic member 16' may be carried out by different means.

FIG. 3 represents a third embodiment of the spatial power combiner 10".

In this embodiment, the absorbent member 15" extends longitudinally in the cavity (not shown in this FIG. 3) starting from the input 11" of the spatial power combiner 10", over a predetermined length.

By way of example that is in no way limiting, the spatial power combiner may have a length of 300 mm, and the absorbent member 50 mm.

According to another example, for a spatial power combiner with low losses, the length of the absorbent member may be 20 mm.

Of course, the values of the lengths of the spatial power combiner and of the absorbent member may be different.

In this embodiment, the spatial power combiner 10" comprises heat dissipation means 17" extending longitudinally in the cavity.

The heat dissipation means 17" comprise a metal rod in an embodiment.

This embodiment is particularly advantageous since the metal rod enables efficient dissipation of the thermal energy in the form of heat produced in the spatial power combiner 10".

In this embodiment, the absorbent member 15" is disposed such that it surrounds the dissipation means 17" over the predetermined length.

Thus, the heat dissipation means 17" extend longitudinally within the whole of the cavity. The absorbent member 15" extends over a predetermined length starting from the input 11" of the spatial power combiner 10". The heat dissipation means 17" are thus surrounded by the absorbent member 15" over the predetermined length.

In an embodiment, the spatial power combiner 10 (see FIG. 1) further comprises a heat evacuation module 18.

This heat evacuation module 18 may be used with different structures of spatial power combiners 10, 10', 10" in particular with the structures represented in FIGS. 2 and 3.

This thermal evacuation module 18 makes it possible to dissipate more of the heat produced in the spatial power combiner 10.

The heat evacuation module 18 is a conventional module known to the person skilled in the art and does not require to be described in detail here.

In the embodiments described, the outputs of the power amplifiers 23 (or outputs 21 of the amplification structure 20) have low impedance.

Furthermore, the inputs 11 of the spatial power combiner 10 also have low impedance.

Furthermore, even though the inputs of the spatial power combiner have low impedance, the output of the combiner has a high impedance.

In an embodiment such as that represented in FIGS. 1*a* and 1*b* the spatial power combiner 10 further comprises an impedance preadaptation module 102. This impedance preadaptation module 102 modifies the value of the impedance present at the input 11 of the spatial power combiner 10.

The impedance preadaptation module comprises the first parts of the transmission lines aa, ba, ca . . . or access lines. Each access line aa, ba, ca . . . comprises a printed circuit comprising at least two conductive layers, one conductive layer transporting the signal and one conductive layer serving as a reference for potential.

Figure 4A:
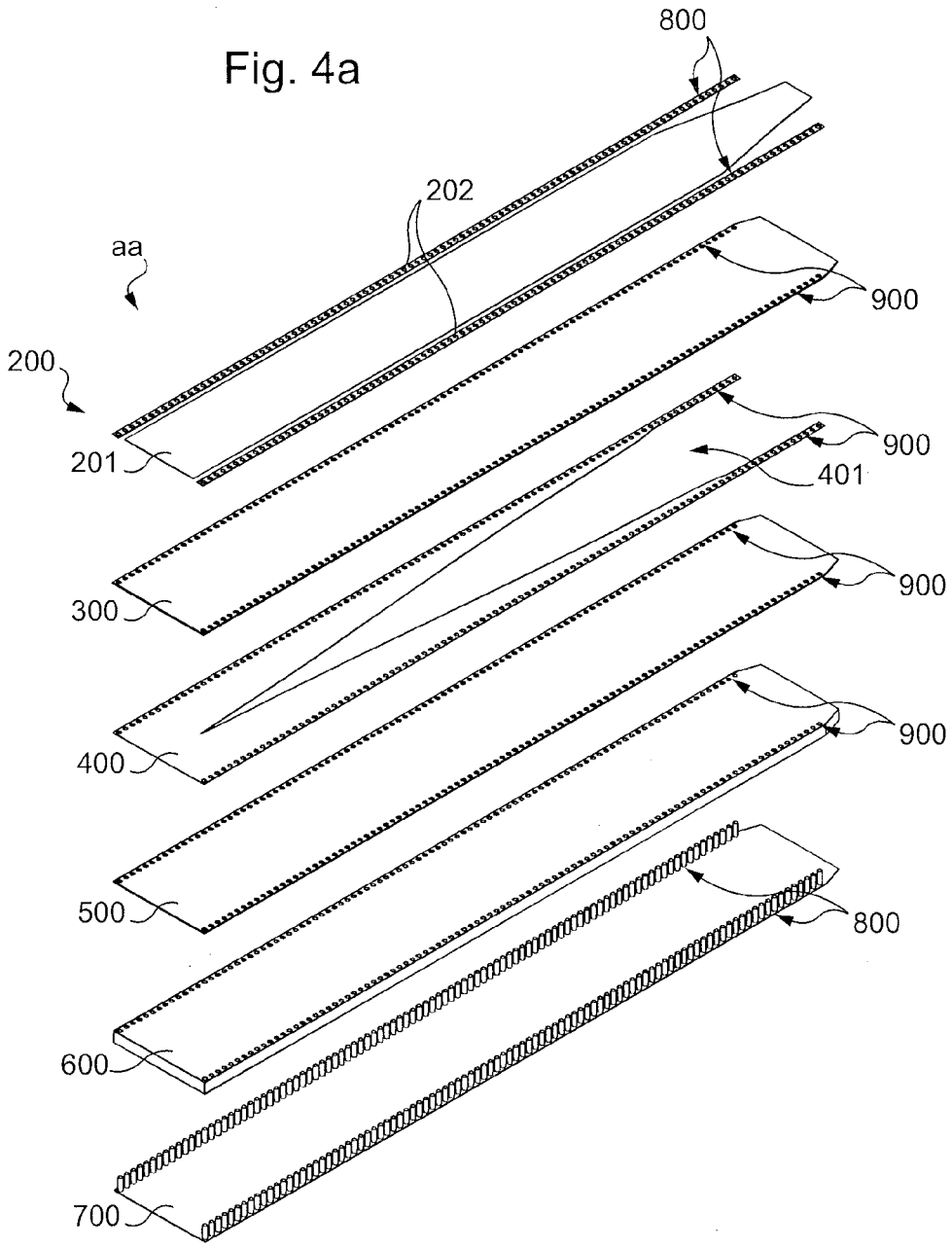
FIGS. 4*a* and 4*b* represent an exploded view of a first part of a transmission line of the power combiner represented in FIGS. 2 and 3 according to two embodiments.
Figure 4B:
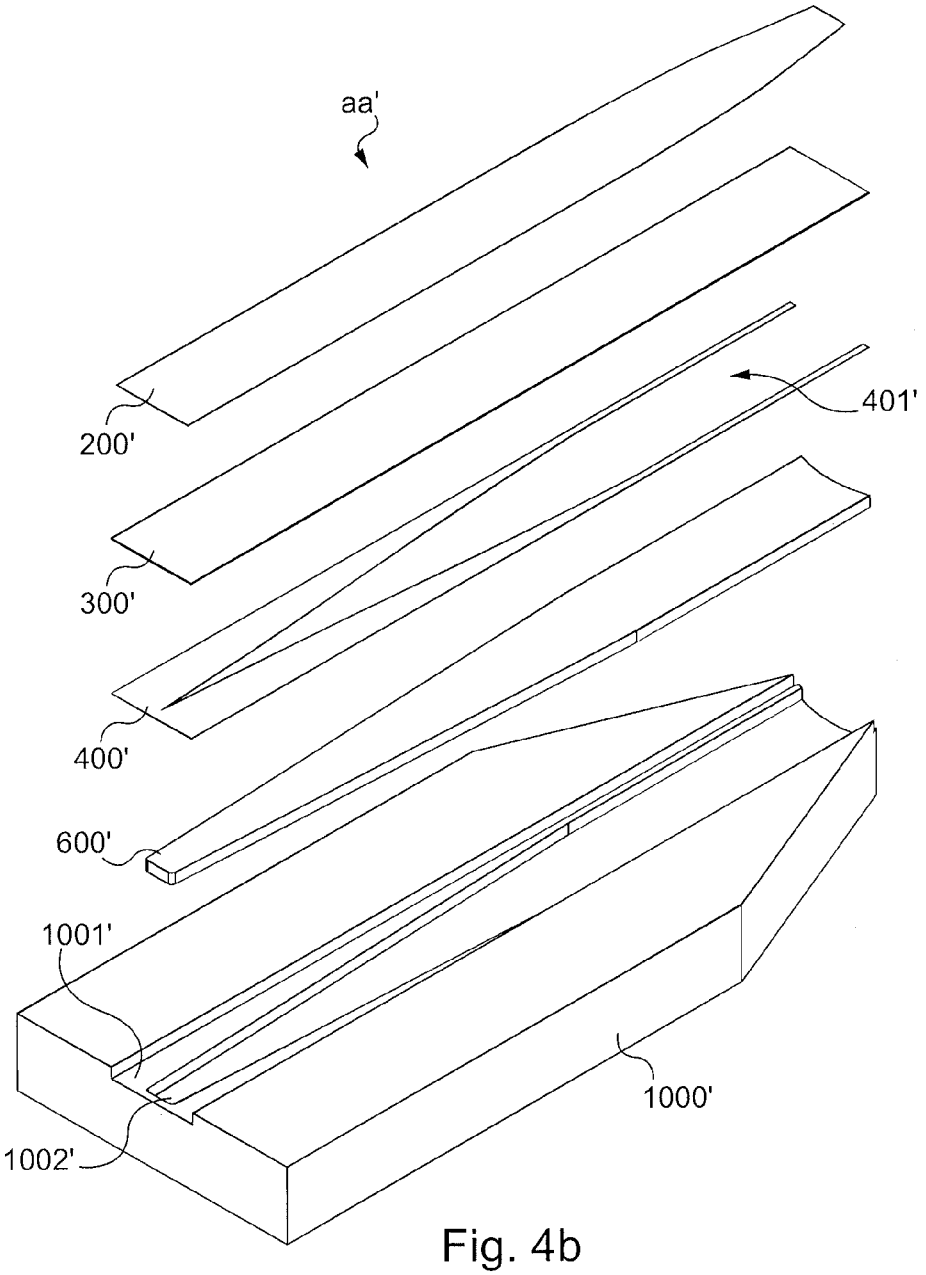

Two embodiments of a printed circuit forming the access lines aa, ba, ca are represented by FIGS. 4*a* and 4*b*.

FIG. 4*a* is a simplified illustration of an exploded view of a printed circuit forming the first part of a transmission line or access line aa of the spatial power combiner 10 according to an embodiment.

Each access line aa, ba, ca, . . . comprises a set of layers superposed relative to each other.

In the embodiment represented in FIG. 4*a*, the set of layers comprises a first conductive layer 200, a second conductive layer 400, as well as a third conductive layer 700.

In this embodiment, the first conductive layer 200 transports a signal, and the second 400 and third 700 conductive layers serve as references for potential.

The set of layers further comprises a first isolating layer 300, a second isolating layer 600 and an adhesive layer 500.

In an embodiment, one of the conductive layers, here being the third conductive layer 700, comprises pins 800 disposed on the edges along the length of the layer.

In this embodiment, each of the other layers (200-600) comprises openings 900 disposed on the edge along the length of the layer, an opening having a complementary shape to that of a pin 800 of the third conductive layer 700 and being situated such that a pin 800 can be inserted into an opening 900 of each layer of the set of layers forming the access line aa.

The set formed by the pins 800 and by the openings 900 forms means for holding or fastening the layers of the set of layers together.

Of course, other manners of fastening or holding may be employed in other embodiments.

Furthermore, the number of layers may be different.

The first conductive layer 200 comprises a central part 201 and two lateral parts 202.

The central part 201 of the first conductive layer 200 transports the signal transported by a transmission line a, of which the power will be combined with that of the other signals transported by the other transmission lines b, c, . . . .

The lateral parts 202 of the first conductive layer 200, the second conductive layer 400 and the third conductive layer 700 serve as reference for potential. The lateral parts 202 of the first conductive layer 200, the second 400 and third 700 conductive layers are linked together by the pins 800, these pins being for example of metal.

A first isolating layer 300 is disposed between the first 200 and the second 400 conductive layer in order to isolate these latter two from each other.

Similarly, the second isolating layer 600 is disposed between the second 400 and the third 700 conductive layers.

In this embodiment, an adhesive layer 500 is disposed between the second conductive layer 400 and the second isolating layer 600.

It will be noted that in the described example, the first conductive layer 200, the second conductive layer 400 and the first isolating layer 300 form a first set, and the third conductive layer 700 and the second isolating layer 600 form a second set, the first and second sets being held together by means of the adhesive layer 500.

Of course, other conductive, isolating and adhesive layers may be added and the order of the layers may be different.

The variation of impedance is provided by the first conductive layer 200 and the second conductive layer 400.

In the example represented, the width of the first conductive layer 200 reduces along the first part of the transmission line aa. The width of the first conductive layer 200 here thus has a smaller value at the output of the impedance preadaptation module 102, 102' (or at the input of the core 101, 101' of the combiner) than at the input of this module 102, 102' (or at the input of the spatial power combiner 10).

The second conductive layer 400 comprises an opening 401. This opening 401, or the width of the opening 401, increases along the first part of the transmission line aa. The opening 401 of the conductive layer 400 is thus greater at the output of the impedance preadaptation module 102, 102' (or at the input of the core 101, 101' of the combiner) than at the input of this module 102, 102' (or at the input of the spatial power combiner 10).

FIG. 4*b* is a simplified illustration of an exploded view of a printed circuit forming the first part of a transmission line or access line as a' of the spatial power combiner 10 according to a second embodiment.

In this embodiment, the set of layers forming the access line aa' comprises a first conductive layer 200', a second conductive layer 400' and an isolating layer 300'.

The assembly formed by these three layers forms the access line aa. This access line aa' is disposed on a support or foot 1000', the second conductive layer 200' being in contact with the hollow 1001'.

In particular, the support 1000' comprises a set of hollows 1001', each hollow 1001' having a suitable shape for receiving the printed circuit forming the access line aa'.

Thus, in the embodiment described the number of hollows is equal to the number of access lines aa', ba', ca', . . . .

Of course, the support 1000' may be in one piece or be formed by a set of supports, each support being associated with an access line aa', ba', ca', . . . .

In this embodiment, the support 1000' further comprises a second hollow 1002' formed in the first hollow 1001', the second hollow 1002' receiving a second isolating layer 600'.

The second isolating layer 600' and the second hollow 1002' thus have complementary shapes.

The second isolating layer 600' disposed in the second hollow 1002' of the support 1000' assists in holding the printed circuit forming the access line aa' disposed in the first hollow 1001' of the support 1000'.

In the described embodiment, the support 1000' is produced from metal.

The first conductive layer 200' transports the signal transported by a transmission line a', of which the power will be combined with that of the other signals transported by the other transmission lines b', c', . . . .

The second conductive layer 400', as well as the metal support 1000' serve as references for potential.

It will be noted that when the printed circuit is inserted into the first hollow 1001' of the support 1000', the second conductive layer 400' is in contact with the support 1000'.

The isolating layer 300' is disposed between the first conductive layer 200' and the second conductive layer 400' in order to isolate them from each other.

As for FIG. 4*a*, other metallization and isolating layers may be added to the set of layers.

Furthermore, the width of the first conductive layer 200' reduces along the first part of the transmission line aa'. The width of the first conductive layer 200 here has a smaller value at the output of the impedance preadaptation module 102, 102' (or at the input of the core 101, 101' of the combiner) than at the input of this module 102, 102' (or at the input of the spatial power combiner 10').

The second conductive layer 400' comprises an opening 401'. This opening 401', or the width of the opening 400', increases along the first part of the transmission line aa'. The opening 401' of the conductive layer 400' is thus greater at the output of the impedance preadaptation module 102, 102' (or at the input of the core 101, 101' of the combiner) than at the input of this module 102, 102' (or at the input of the spatial power combiner 10').

In embodiments in which the spatial power combiner does not comprise an impedance preadaptation module 101, 101', the impedance variation between the input and the output of the spatial power combiner is provided only by the coaxial structure of the combiner core 101, 101'.

In all the embodiments, the common-mode impedance of the transmission lines of the coaxial structure of the power combiner increases along the coaxial structure of the combiner core 101, 101'. This increase is made by a reduction in the ratio between the diameter formed by the set of the transmission lines situated within the cylindrical body 13 and the inside diameter of the cylindrical body 13 of the core of the spatial power combiner 10.

It will be noted that the disposition of the lines within the cylindrical body 13 and the actual cylindrical body 13 form a coaxial structure.

The invention claimed is:

1. A spatial power combiner comprising:

a plurality of inputs to which a set of transmission lines are respectively linked;

an output; and a body defining a cavity, wherein the set of transmission lines comprise microstrip transmission lines and pass longitudinally through the cavity and are disposed around an absorbent member that also extends longitudinally in the cavity from the input of the spatial power combiner.

2. The spatial power combiner according to claim 1, wherein a length of the absorbent member is equal to a length of the transmission lines.

3. The spatial power combiner according to claim 1, wherein a length of the absorbent member is less than a length of the transmission lines.

4. The spatial power combiner according to claim 3, wherein the absorbent member also extends from to the output of the spatial power combiner.

5. The spatial power combiner according to claim 1 further comprising heat dissipation device extending longitudinally in the cavity, the absorbent member surrounding the dissipation device.

6. The spatial power combiner according to claim 5, wherein the heat dissipation means device comprises a metal rod.

7. The spatial power combiner according to claim 1, wherein the plurality of inputs have a low impedance.

8. The spatial power combiner according to claim 1 further comprising a heat evacuation module.

9. The spatial power combiner according to claim 1 further comprising an impedance preadaptation module at the input, the impedance preadaptation module comprising first portions of the plurality of transmission lines.

10. The spatial power combiner according to claim 9, wherein each first portion of the plurality of transmission lines comprise a set of layers, the set of layers comprising:

at least one first conductive layer transporting a signal and having a width the reduces along the first portion of the plurality of transmission lines; and at least one second conductive layer serving as a reference for potential and comprising an opening having a width that increases along the first portion of the plurality of transmission lines.

11. The spatial power combiner according to claim 10, wherein the set of layers comprises a third conductive layer serving as a reference for potential.

12. The spatial power combiner according to claim 9, wherein the impedance preadaptation module comprises a support carrying the first portions of the plurality of transmission lines, the support including a set of hollows, wherein the first portion of each of the plurality of transmission lines are respectively disposed in a hollow of the set of hollows.

13. A power amplification set including the spatial power combiner in accordance with claim 1, and an amplification structure at the input of the spatial power combiner, the amplification structure comprising a plurality of inputs and a plurality of outputs, wherein the plurality of outputs are respectively linked to the plurality of inputs of the spatial power combiner.

14. The power amplification set according to claim 13, wherein the amplification structure comprises a plurality of power amplifiers, each power amplifier linked to an output of the plurality of outputs of the amplification structure.

15. The power amplification set according to claim 14, wherein the plurality of outputs of the power amplifiers have low impedance.

* * * * *